United States Patent [19]

Burke

[11] 4,123,643

[45] Oct. 31, 1978

[54] AIR CIRCULATION SYSTEM FOR MICROWAVE OVEN

[75] Inventor: Harry D. Burke, Marion, Ohio

[73] Assignee: Whirlpool Corporation, Benton Harbor, Mich.

[21] Appl. No.: 801,834

[22] Filed: May 31, 1977

[51] Int. Cl.[2] ..... H05B 9/06

[52] U.S. Cl. ..... 219/10.55 R; 126/273 R

[58] Field of Search ..... 219/10.55 R, 10.55 D, 219/10.55 B, 10.55 C; 126/273 R

[56] References Cited

U.S. PATENT DOCUMENTS

| | | | |
|---|---|---|---|
| 2,860,026 | 11/1958 | Long | 219/10.55 B |
| 3,654,417 | 4/1972 | Javes et al. | 219/10.55 R |
| 3,681,557 | 8/1972 | Suzuki et al. | 219/10.55 D |
| 3,716,687 | 2/1973 | Constable | 219/10.55 B X |
| 3,746,823 | 7/1973 | Whiteley | 219/10.55 F |
| 3,783,219 | 1/1974 | Tateda | 219/10.55 D |
| 3,789,179 | 1/1974 | Haagensen | 219/10.55 F |
| 3,829,649 | 8/1974 | Igarashi | 219/10.55 B |
| 4,028,520 | 6/1977 | Torrey | 219/10.55 B |

*Primary Examiner*—Arthur T. Grimley

*Attorney, Agent, or Firm*—Wegner, Stellman, McCord, Wiles & Wood

[57] ABSTRACT

An improved air circulation system for a microwave oven having an improved air inlet for delivering ambient air to the microwave energy generating device. The air inlet is defined in part by a formed portion of the cabinet providing an air channel to the front and rear of the oven for subsequent flow to the generating device. A first portion of the delivered air is conducted to the oven space while a second portion of the air is heated by heat transfer association with the magnetron structure of the generating device. The heated air is subsequently divided into two paths. In one path, the heated air is directed through a suitable outlet to exteriorly of the cabinet. In the other path, the heated air is directed through an upper cavity portion of the heating space to a rear portion of the lower oven cavity. The heated air, together with the air delivered substantially directly from the generator space to the lower cavity, is discharged through a front, upper opening of the cabinet. The improved air flow provides improved efficiency and cooking operation of the oven device.

20 Claims, 5 Drawing Figures

AIR CIRCULATION SYSTEM FOR MICROWAVE OVEN

BACKGROUND OF THE INVENTION

1. Field of the Invention

This invention relates to microwave ovens and in particular to means for providing air flow through microwave ovens.

2. Description of the Prior Art

In a microwave oven, a microwave energy generating means is provided for producing from a conventional power supply, such as a 120-volt 60-cycle alternating current power supply, high frequency microwave energy for heating and cooking food placed in an oven portion of the appliance.

It is desirable to provide an air flow for cooling the microwave energy generating means and it is further desirable to provide an air flow through the oven cavity for dissipating moisture and the like produced in the heating and cooking of the food therein. A substantial number of different arrangements for effecting such air flow have been developed in the prior art.

Illustratively, George B. Long, in U.S. Pat. No. 2,860,026, shows a domestic appliance wherein a magnetron tube is cooled by a blower disposed between the tube and an upper opening in the cabinet. The apparatus is further cooled by a fan drawing air in through an inlet at the bottom of the cabinet, as illustrated in FIG. 1 of the patent. In describing the disclosed structure, Long characterizes the air flow as oppositely to that shown in FIG. 1 of his patent.

Louis P. Polries et al., in U.S. Pat. No. 3,127,495, show a microwave oven having an air flow from an inlet over a microwave generating apparatus in the lower portion of the cabinet and upwardly therefrom through a vertical duct through the cooking space to a front outlet.

In U.S. Pat. No. 3,281,568, Duane B. Haagensen shows an oven control system wherein the cabinet is provided with inlet openings in a front portion thereof and exhaust louvers in the top of the cabinet. The air is moved through the cabinet by means of an exhaust fan with the metallic walls of the oven cavity being cooled by the air circulating over them. A portion of the air stream drawn through the inlet is channeled by a deflector plate into an air pump with the interior of the oven being ventilated by air forced down into the oven cavity by the air pump. The air in the cavity exits through an exhaust duct venting the exhaust air to the exhaust fan.

In U.S. Pat. No. 3,308,261 of Leonard Velander, a microwave oven construction is shown having a plurality of ducts including a first duct connected at one end to a source of pressurized air and at the other end to the exterior of the oven. A second duct provides communication between the cooking cavity and the first duct for aspirating air from the cooking cavity. The device utilizes a single blower for cooling the magnetron and aspirating air from the cooking cavity.

Egbert M. Tingley, in U.S. Pat. No. 3,430,023, shows a microwave oven wherein air is forced into the oven cavity and vented through a series of outlet perforations formed along the front edge of the upper wall of the oven liner.

In U.S. Pat. No. 3,576,417, Egbert M. Tingley shows an electronic oven appliance wherein a blower draws air through a group of louvers at the rear of the cover and passes the air over the electronic components for cooling the same. The air is then exhausted from the component area through perforations is the component tray and through a plastic cover attached to the underside of the component tray from which it enters the oven cavity through an opening in the rear of the plastic cover. From the oven cavity, the air then exits through a group of spaced perforations in the front door of the appliance.

Wallace R. Javes et al., in U.S. Pat. No. 3,654,417, show a microwave oven having an air flow system including a blower for providing heated air flow with one portion thereof being directed into the cavity by suitable duct means. A filter is located on the air exhaust of the cavity for collecting condensation. Another portion of the heated air flow is directed outwardly from the cabinet.

Masataka Suzuki et al. show, in U.S. Pat. No. 3,681,557, a microwave oven wherein cooling air is flowed against the magnetron with the thusly heated air being directed as a hot air air flow directly onto and generally parallel with a major inner surface of the inspection window of the apparatus. This air flow then flows through and across the cooking compartment. The air is then exhausted through a rear, downwardly directed outlet of the cabinet.

Ryumi Igarashi discloses, in U.S. Pat. No. 3,829,649, a microwave oven having a baffle plate in the upper portion of the oven cavity. A fan is provided for cooling the oscillator and circulating air through the cooking chamber with the air entering through a bottom wall of the cabinet and being directed downwardly from the top of the cabinet into the cooking chamber portion of the oven.

In U.S. Pat. No. 3,878,350 of Yutaka Takagi, a microwave oven is shown having an air inlet at the bottom of the cabinet and an air inlet at the top of the cabinet with a fan at the rear of the cabinet discharging the air through an outlet in the rear wall. A blower is provided for directing a portion of the air outwardly through the oven cavity and outwardly through a rear opening to the rear fan.

SUMMARY OF THE INVENTION

The present invention comprehends an improved microwave oven structure having a cabinet defining a front opening, wall means within the cabinet dividing the interior of the cabinet into an oven space accessible through the cabinet front opening and a generating space, electrically operated generator means in the generating space for generating microwave energy, and waveguide means for conducting the microwave energy from the generating means to the oven cavity. The oven structure further includes an improved air flow means defined by a bottom wall portion of the cabinet cooperating with the wall means to define means for conducting ambient air into the cabinet under the oven space and fowardly and rearwardly therefrom to pass into a front portion and a rear portion of the cabinet for delivery to the generator space.

The invention further comprehends such a microwave oven structure wherein an improved air flow means is provided defined by a partition wall means dividing the oven space into an upper cavity and a main lower oven cavity, the partition wall means having a rear portion provided with an opening for conducting air from the upper cavity to the rear of the lower oven cavity, means for conducting ambient air into the generating space to be heated by the generating means therein, means for conducting the heated air from the generating space into the upper cavity for flow therefrom through the opening into the rear portion of the oven cavity, and means for discharging the heated air from a front portion of the oven cavity.

Still further, the invention comprehends such a microwave oven structure wherein the improved air flow means is defined by inlet passage means associated with the cabinet and wall means for conducting ambient air into the generating space, first outlet passage means for conducting ambient air from the generating space substantially directly into the oven space after passing over only a part of the generating means, and second outlet passage means associated with the cabinet and wall means for conducting air heated by contact with substantially all of the generating means in a first path into the oven space, and in a second path substantially directly from the generating space to exteriorly of the cabinet.

More specifically, the invention comprehends such a microwave oven air flow means wherein air is drawn into the bottom of the cabinet by a fan mounted adjacent the magnetron of the microwave energy generating means. Substantially all of the air is drawn past the power supply components for the magnetron with part of the flowed air directed into the oven cavity and the remainder of the flowed air directed over the cooling fins of the magnetron. A portion of the air flowed over the cooling fins is exhausted through the microwave energy waveguide into an upper portion of the oven space and directed into the rear of the oven cavity. The two portions of heated air thusly in the oven cavity intermix and absorb moisture from the food being heated and cooked in the oven cavity. This air is then exhausted through a front opening to provide improved heating and cooking of the food therein. The other portion of the air heated by the magnetron fins is exhausted substantially directly from the cabinet for improved cooling of the magnetron.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
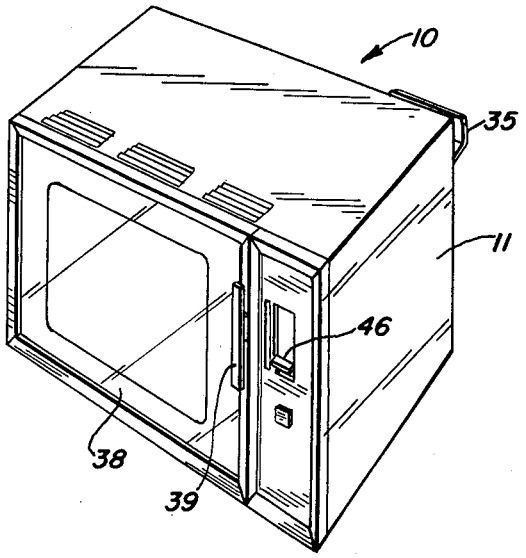
FIG. 1 is a perspective view of a microwave oven structure embodying the invention.

In the exemplary embodiment of the invention as disclosed in the drawing, a microwave oven structure generally designated 10 is shown to comprise an outer cabinet 11. Wall means generally designated 12 are provided within the cabinet for cooperation therewith in providing an improved air flow through the oven structure. The wall means define an oven space 13 and a microwave energy generating space 14. Oven space 13 is divided into an upper cavity 15 and a lower oven cavity 16 by a partition wall 17 defining a stirrer cover formed of a suitable radiation transmitting synthetic resin.

Microwave energy is delivered to the oven space 16 from a microwave energy generating apparatus 18 through a suitable waveguide 19 which directs the energy into the upper cavity 15 and downwardly through the permeable partition wall 17 into the oven cavity 16. The generating apparatus may include a conventional magnetron generator 20 having cooling fins 21. A suitable air moving device in the form of a fan 22 may be provided subjacent the magnetron and spaced above a power transformer 23 and other elements of a power supply for the generating apparatus. The transformer 23 may be carried on a bottom wall 24 of the cabinet 11.

Figure 2:
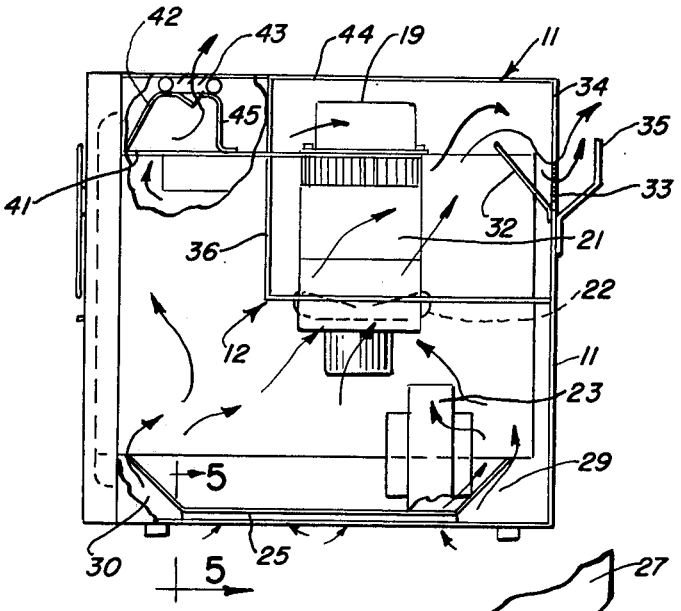
FIG. 2 is a side elevation thereof shown partially in vertical section.
Figure 5:
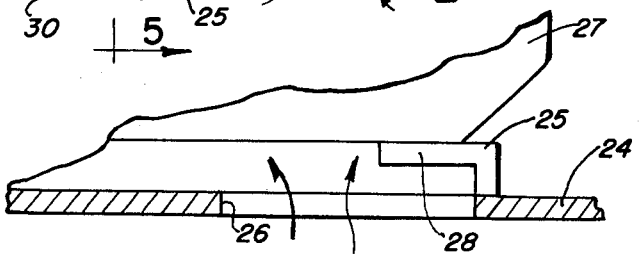
FIG. 5 is a fragmentary enlarged vertical section taken substantially along the line 5—5 of FIG. 2.
Figure 4:
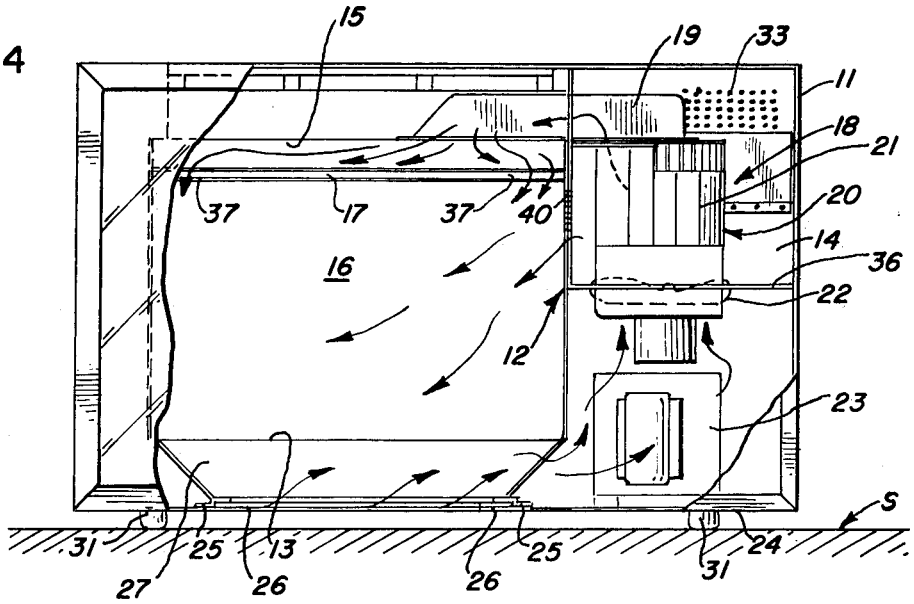
FIG. 4 is a front elevation thereof shown partially in transverse vertical section.

As best seen in FIGS. 4 and 5, bottom wall 24 is provided with a pair of spaced upset portions 25 forming corresponding pairs of air inlet openings 26. Wall means 12 includes a portion defining an upwardly tapered bottom wall 27 subjacent the oven cavity 16 which rests on inturned flange portions 28 of the Z-shaped upset wall portions 25. As shown in FIG. 2, the upset portions 25 extend substantially the length of the bottom of the base wall 27 and, thus, deliver the inlet air under the base wall 27 to a rear space 29 and a front space 30 within the cabinet 11. As shown in FIG. 4, the bottom wall 24 is provided with a plurality of downwardly projecting legs 31 spacing the opening 26 slightly above the subjacent surface S on which the microwave oven may rest. Thus, free air delivery into the openings 26 is permitted under the bottom wall 24 to permit the ambient air to be drawn through the openings 26 by the fan 22 which, as shown in FIGS. 2 and 4, communicate freely with the spaces 29 and 30 to which the air is delivered from the space subjacent the base wall 27.

As shown in FIG. 2, the air passing from space 29 and some of the air from space 30 flows in heat transfer association with the transformer 23 for effectively cooling the transformer.

Figure 3:
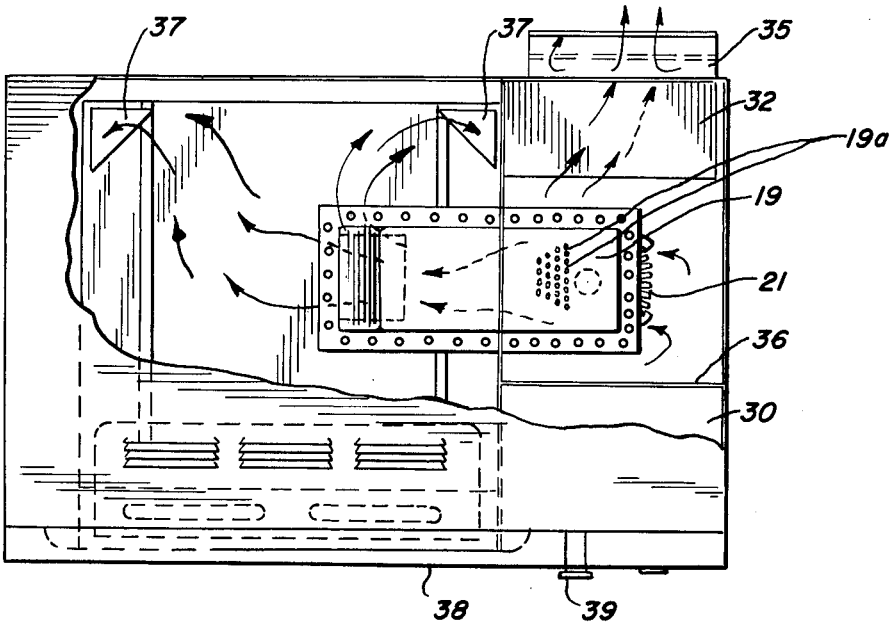
FIG. 3 is a top plan view thereof shown partially in horizontal section.

As further shown in FIGS. 2 and 3, a portion of the air forced upwardly by fan 22 flows over the cooling fins 21 of the magnetron and thence around a baffle 32 to outlet openings 33 in the rear wall 34 of the cabinet. A deflector baffle 35 is provided on the exterior of the rear wall 34 for deflecting the discharged air upwardly from openings 33.

As shown in FIGS. 2, 3 and 4, the magnetron is enclosed in a baffle 36 permitting the fan to draw air from within the cabinet 11 and deliver it upwardly against the magnetron as discussed above. As shown in FIG. 4, waveguide 19 extends through the baffle wall and includes suitable air passage openings **19*a* so as to conduct a portion of the heated air together with the microwave energy from the generating space 14 through the waveguide into the upper cavity 15. While the microwave energy is free to pass downwardly through the microwave energy permeable partition wall 17, the air flow is prevented from free downward movement into oven cavity 16 by the wall 17 and is caused to move rearwardly, as shown in FIG. 3, to pass down through a pair of rear corner openings 37 in the partition wall 17** into the oven cavity.

As shown in FIG. 1, the front opening of oven cavity 16 is selectively closed by a suitable hingedly mounted door 38 and a suitable manipulating handle 39. A portion of the air delivered by fan 22 into the generating space 14 is delivered substantially directly therefrom to the oven cavity 16 through suitable openings 40 in the baffle 36. This air, together with the heated air delivered to the cavity through openings 37 in the partition wall 17, flows forwardly through the cavity as shown in FIG. 2 through suitable upper front openings 41 in the wall means defining the top of the oven cavity and around a suitable baffle 42 upwardly through louvers 43 in the top wall 44 of cabinet 11. As shown in FIG. 2, the wall means may include a suitable portion 45 defining an outlet passage between openings 41 and louvers 43.

Thus, in operation of the microwave oven, the user places the food or other material to be heated in the oven cavity 16 and closes the door 38. He may then operate the control 46 to effect operation of the microwave energy generating means 18, the fan 22 being energized concurrently therewith. Thus, during the heating of the material in oven cavity 16, air is caused to flow by fan 22 through the inlet openings 26 forwardly and rearwardly under the oven bottom wall 27 and thence around transformer 23 and other power supply elements (i.e. diodes, resistors, etc. not shown) to the fan 22. A portion of the air so moved by the fan 22 is delivered directly to the oven cavity 16 by a lateral flow through openings 40. The remainder of the air so flowed by the fan 22 is directed upwardly in heat transfer association with the magnetron cooling fins 21 and this second stream is further divided into two streams, one of which is directed around the baffle 32 outwardly from the cabinet 11 through the openings 33 with this discharged air being directed upwardly by the outer baffle 35. The other of the two streams is directed with the microwave energy through suitable openings in the waveguide 19 and is delivered into the upper cavity 15 defined by the divider wall 17. This air is then caused to move through the rear openings 37 downwardly into the oven cavity 16.

The thusly heated air delivered through openings 37 and the air delivered directly to the oven cavity through openings 40 mixes together and is then discharged from the front of the oven cavity 16 through the outlet openings 41 and louvers 43. The outlet openings 41 and inlet openings **19*a*** are sized so as to prevent microwave energy passage through the openings while permitting free flow of the air therethrough as discussed above.

The foregoing disclosure of specific embodiments is illustrative of the broad inventive concepts comprehended by the invention.

The embodiments of the invention in which an exclusive property or privilege is claimed are defined as follows:

1. In a microwave oven having a cabinet defining a front opening, wall means within the cabinet dividing the interior of the cabinet into a oven space accessible through said cabinet front opening and a generating space, electrically operated generator means in said generating space for generating microwave energy, and waveguide means for conducting the microwave energy from the generating means to said oven cavity, improved air flow means comprising a bottom wall portion of said cabinet cooperating with said wall means to define means for conducting ambient air into said cabinet under said oven space and forwardly and rearwardly therefrom to pass through a front portion and a rear portion of the cabinet to said generating space.

2. The microwave oven structure of claim 1 wherein said generating space is in a side portion of said cabinet.

3. The microwave oven structure of claim 1 wherein said bottom wall portion defines Z-shaped channels extending forwardly and rearwardly to said front and rear portions of the cabinet.

4. The microwave oven structure of claim 1 wherein said bottom wall portion defines integral Z-shaped channels extending forwardly and rearwardly to said front and rear portions of the cabinet.

5. The microwave oven structure of claim 1 wherein said bottom wall portion defines integral Z-shaped channels extending forwardly and rearwardly to said front and rear portions of the cabinet, said channels being upset from said bottom wall to define air inlet openings extending the length of said channels.

6. The microwave oven structure of claim 1 wherein said generating space is in a side portion of said cabinet and is spaced substantially above the bottom wall of the cavity to receive the forwardly and rearwardly conducted cooling air effectively directly from said channel means.

7. The microwave oven structure of claim 1 wherein said wall means includes a downwardly tapered wall defining a base portion of the wall means forming said oven space, and said bottom wall portion of the cabinet defines upstanding support means, said base portion being carried on said support means.

8. The microwave oven structure of claim 1 wherein said bottom wall portion defines inturned uprights defining therebetween the sides of said air conducting means.

9. In a microwave oven having a cabinet defining a front opening, wall means within the cabinet dividing the interior of the cabinet into an oven space accessible through said cabinet front opening and a generating space, electrically operated generator means in said generating space for generating microwave energy, and waveguide means for conducting the microwave energy from the generating means to said oven cavity, improved air flow means comprising:

partition wall means dividing the oven space into an upper cavity and a main lower oven cavity, said partition wall means having a rear portion provided with an opening for conducting air from said upper cavity to the rear of said lower oven cavity;

means for conducting ambient air into said generating space to be heated by said generating means therein;

means for conducting heated air from said generating space into said upper cavity for flow therefrom through said opening into the rear portion of said lower oven cavity; and means for discharging the heated air from a front portion of said lower oven cavity.

10. The microwave oven structure of claim 9 wherein said wall means further define passage means for conducting heated air from said generating space substantially directly into said lower oven cavity.

11. The microwave oven structure of claim 9 wherein said discharge means comprise passage means for conducting the heated air from an upper front portion of said lower oven cavity.

12. The microwave oven structure of claim 9 further including means for conducting a portion of the air substantially directly outwardly from said generating space to exteriorly of said cabinet.

13. The microwave oven structure of claim 9 wherein said means for conducting the microwave energy defines a portion of the means for conducting the heated air to said upper cavity.

14. In a microwave oven having a cabinet defining a front opening, wall means within the cabinet dividing the interior of the cabinet into an oven space accessible through said cabinet front opening and a generating space, electrically operated generator means in said generating space for generating microwave energy, and waveguide means for conducting the microwave energy from the generating means to said oven cavity, improved air flow means comprising:

inlet passage means associated with said cabinet and wall means for conducting ambient air into said generating space;

first outlet passage means for conducting ambient air from said generating space substantially directly into said oven space; and second outlet passage means associated with said cabinet and wall means for conducting air heated by said generating space in a first path into said oven space, and in a second path substantially directly from said generating space to exteriorly of said cabinet.

15. The microwave oven structure of claim 14 wherein said cabinet is provided with an upwardly directed external deflector for directing the heated air from said second path upwardly from the cabinet generally away from said inlet passage means.

16. The microwave oven structure of claim 14 wherein said second outlet passage means includes an outlet opening through said cabinet and a baffle within said cabinet adjacent said outlet openings for controlling the discharge air flow outwardly through said outlet opening.

17. The microwave oven structure of claim 14 wherein said second outlet passage means first path enters the oven space at a top portion thereof, and includes discharge means for conducting the air from a front portion of the oven space to exteriorly of the cabinet.

18. The microwave oven structure of claim 14 wherein said inlet passage means comprises means for flowing the cabinet air against a portion of the wall means defining said oven space prior to delivery thereof to said generating space.

19. The microwave oven structure of claim 14 wherein said generating means includes air moving means.

20. The microwave oven structure of claim 14 wherein said inlet passage means includes a bottom wall portion of said cabinet cooperating with said wall means to define means for conducting ambient air into said cabinet under said oven space and forwardly and rearwardly therefrom to pass into a front portion and a rear portion of the cabinet for delivering to said generating space.

* * * * *